US006100489A

United States Patent [19]

Zehnder et al.

[11] Patent Number: 6,100,489

[45] Date of Patent: Aug. 8, 2000

[54] CONSUMABLE SWITCHING ARRANGEMENT

[75] Inventors: Lukas Zehnder, Baden-Dättwil; Robert Anderes, Siebnen, both of Switzerland; Christian Dähler, Greensburg, Pa.; Kurt Kaltenegger, Lengnau, Switzerland; Thomas Schoenemann, Buchs, Switzerland; Klaus-Dieter Weltmann, Baden-Dättwil, Switzerland

[73] Assignee: Asea Brown Boveri AG, Baden, Switzerland

[21] Appl. No.: 09/290,388

[22] Filed: Apr. 13, 1999

[30] Foreign Application Priority Data

Apr. 14, 1998 [DE] Germany ..... 198 16 507

[51] Int. Cl.[7] ..... H01H 33/12; H01H 33/985; H01H 1/38; H01H 1/46; H01H 33/66

[52] U.S. Cl. ..... 218/17; 218/48; 218/57; 218/65; 218/74; 218/146

[58] Field of Search ..... 218/17–21, 48–50, 218/65, 74, 146, 57–64, 66; 200/245, 287, 248

[56] References Cited

U.S. PATENT DOCUMENTS

| | | | |
|---|---|---|---|
| 4,668,848 | 5/1987 | Kowalyshen et al. | 218/48 X |
| 4,684,773 | 8/1987 | Niemeyer | 218/46 |
| 5,298,704 | 3/1994 | Opfer | 218/84 |
| 5,902,978 | 5/1999 | Zehnder et al. | 218/57 |

FOREIGN PATENT DOCUMENTS

| | | |
|---|---|---|
| 0177714B1 | 4/1986 | European Pat. Off. . |
| 3440212A1 | 4/1986 | Germany . |
| 19613569A1 | 10/1997 | Germany . |

*Primary Examiner*—J. R. Scott
*Attorney, Agent, or Firm*—Burns, Doane, Swecker, Mathis, L.L.P.

[57] ABSTRACT

In the switched-on position, under the influence of contact forces generated by elastic deflection or else by mechanical spreading, or spreading caused by the attraction of parallel currents or repulsion of antiparallel currents, of a switching pin (5) , the switching pins presses against the inner side of a first switching ring (4), which is rigid for the purpose of avoiding mechanical overloading and securing sufficient consumable reserves. By way of example, a support (30) of the switching pin (5) is adjoined by two parallel, elastic extensions **(52*a*, 52*b*), which are separated by a slot (53) and respectively support a contact member (54*a*; 54*b*) by means of a connecting element (55*a*; 55*b*) forming half a screw thread, with the result that said contact member is in each case offset by 180° relative to the extension (52*a*; 52*b*). In the switched-on position, therefore, the contact members (54*a*, 54*b*) are forced apart by the elastic deformation of the extensions (52*a*, 52*b*) which is caused by the attraction between the parallel partial currents through said contact members. The switching pin (5) is electrically conductively connected to a second switching ring (6), which is separated from the first switching ring (4)** by an arc space.

40 Claims, 16 Drawing Sheets

CONSUMABLE SWITCHING ARRANGEMENT

BACKGROUND OF THE INVENTION

1. Field of the Invention

The invention relates to a consumable switching arrangement particularly for circuit-breakers of the kind used in power stations, transformer substations and other equipment appertaining to the supply of electrical power for the purpose of switching operating currents and overcurrents on and off.

2. Discussion of Background

EP-B-0 177 714 discloses a generic consumable switching arrangement in which the first switching member is designed as a contact tulip with a plurality of relatively long, parallel contact fingers distributed over the periphery thereof. It has been shown that such an arrangement is susceptible to damage at high currents, since the contact fingers carry parallel currents and are therefore pulled toward one another by electromagnetic forces. This can lead to the contact fingers being bent and twisted. As a result, the friction forces between switching pin and contact fingers can also reach very high values, so that large driving forces are necessary and a high degree of abrasion occurs on the switching pin and the contact fingers. Since, as a rule, the contact fingers are separated only by narrow slots, they offer, moreover, a small consumable reserve since their radial freedom of movement is limited.

SUMMARY OF THE INVENTION

Accordingly, one object of the invention is to provide a novel consumable switching arrangement in which the switching members are not overloaded mechanically even at high currents. At the same time, however, contact forces are intended to be generated which counteract the contact lift-off forces that are effective between the switching pin and the first switching member interacting with the latter, and compensate for said contact lift-off forces in such a way that the required contact pressure is always ensured.

According to the invention, this is achieved by providing a first switching member which comprises a first switching ring, and a second switching member which comprises a switching pin and a second switching ring; the second switching ring, in the direction of the switching axis, being separated from the first switching member by an arc space. The present invention further provides that the switching pin is mounted such that it presses against the first switching member in a first contact zone and against the second switching ring in a second contact zone in the switched-on position under the action of mechanically or electromagnetically generated contact forces, thereby ensuring that the first switching member can readily withstand even high mechanical loading. In this case, the contact pressure is obtained primarily by the inventive design or mounting of the switching pin, which, by the contact with the first switching member, is deflected or deformed or is spread by the electromagnetic forces occurring in the region of the contact zone. In addition, a comparatively large consumable reserve can always be ensured in this way. Particularly favorable in this regard are embodiments in which the switching pin presses laterally against the inner side of the first switching member designed as a switching ring, since the contact zone and the tip of the switching pin, said tip carrying the arc root, can then be designed in each case independently of one another in accordance with their particular tasks.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
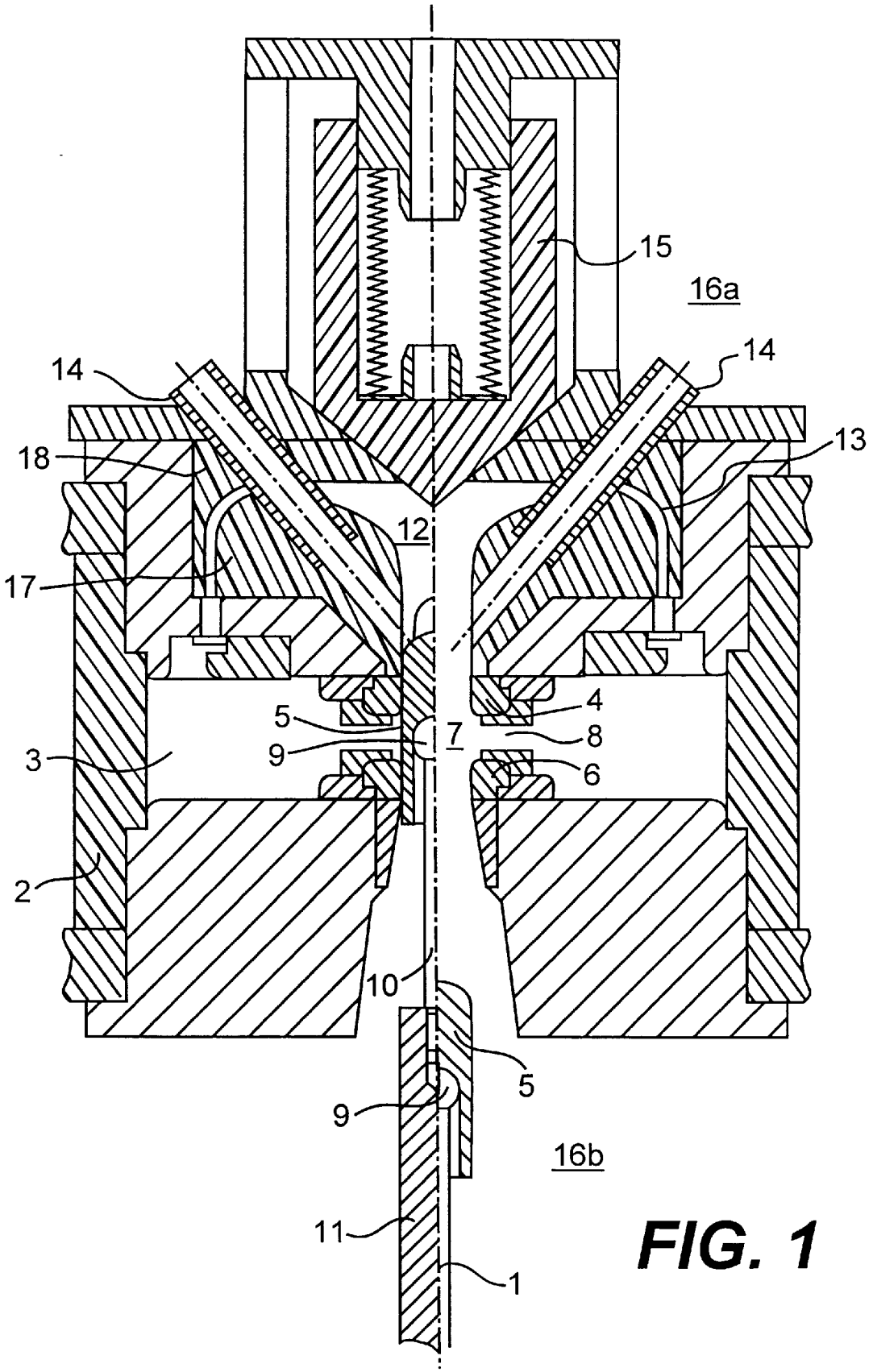
FIG. 1 shows an axial longitudinal section through a consumable switching arrangement in accordance with a first embodiment of the invention, in the switched-on position on the left and in the switched-off position on the right.

Referring now to the drawings, wherein like reference numerals designate identical or corresponding parts throughout the several views, the consumable switching arrangement of a circuit-breaker in accordance with a first embodiment of the invention, said consumable switching arrangement being illustrated in the switched-on position on the left and in the switched-off position on the right in FIG. 1, has, in a housing 2 made of insulating material, said housing being rotationally symmetrical about a switching axis 1, an annular heating volume 3, which surrounds a first switching member, which is connected to a first electrical terminal (not illustrated), as well as a second switching member. The first switching member is designed as a first switching ring 4; the second switching member comprises a switching pin 5 and a second switching ring 6, which is connected to a second electrical terminal (not illustrated). An arc space 7 lies between the first switching ring 4 and the second switching ring 6, which are arranged concentrically with respect to the switching axis 1, said arc space being connected to the heating volume 3 via a peripheral blowing slot 8 bounded on both sides by electrically insulating partial end coverings of the first switching ring 4 and of the second switching ring 6.

The switching pin 5 is mounted such that it can tilt by means of a ball and socket joint 9 on an elastic rod 10, with the result that it can be tilted about a tilt axis which is oriented transversely with respect to the switching axis 1 but is otherwise not fixed. The rod 10 is fastened to a mount 11, which can be displaced along the switching axis 1 between the switched-on position and the switched-off position by a switching drive (not illustrated).

In the axial continuation of the arc space 7, a pressure space 12 is arranged behind the first switching ring 4, which pressure space is connected to the heating volume 3 by means of a rotationally symmetrical return channel 13, which branches off laterally on all sides, via a nonreturn valve and to a first exhaust volume 16*a* by means of exhaust pipes 14 as well as a central excess-pressure valve 15. The pressure space 12 and the return channel 13 are bounded by a cover 17 and a cap 18, both made of insulating material. The opening in the second switching ring 6 expands in the axial continuation of the arc space 7 toward a second exhaust volume 16*b*. Stationary and moveable rated current contacts which are arranged outside the consumable switching arrangement and are electrically conductively connected respectively to the first and second electrical terminals are not illustrated.

The rod 10 is slightly inclined relative to the switching axis 1, with the result that the switching pin 5 is displaced somewhat laterally relative to the same in the rest position, which it assumes in the switched-off position. During turn-on, said pin is deflected laterally by the contact firstly with the second switching ring 6 and then also with the first switching ring 4, with the rod 10 being bent elastically, with the result that elastic restoring forces which press the switching pin 5 laterally against the switching rings act in the rod 10. Since the ball and socket joint 9 and, consequently, the pivot point of the switching pin 5 lie between the first switching ring 4 and the second switching ring 6 in the axial direction, the inclination of the switching pin 5 is adapted in this case in such a way that said pin presses against the inner sides of both switching rings. The contact forces thus generated between the switching pin 5, on the one hand, and the first switching ring 4 and the second switching ring 6, on the other hand, suffice to compensate for the contact lift-off forces and to ensure a sufficient contact pressure even at high currents.

The first switching ring 4, the second switching ring 6 and the switching pin 5 are composed of erosion-resistant material, e.g. WCu, graphite, CFC, graphite/Cu or CFC/Cu.

In the switched-on position, the current path in the consumable switching arrangement runs from the first switching ring 4 via the switching pin 5 to the second switching ring 6. During switch-off, the switching pin 5 is pulled from the first switching ring 4, an arc forming between them. When the tip of the switching pin 5 passes the second switching ring 6, the arc root jumps across from the switching pin 5 to said switching ring. The heating of the gas in the heating volume 3 by the arc and also the partial diversion of the pinch pressure, generated by the arc in the pressure space 12, via the return channel 13 into the same leads to the build-up of a high gas pressure in the heating volume 3, which causes the gas to escape through the blowing slot 8 into the arc space 7 and further into the exhaust volumes 16*a*, 16*b* upon the next zero crossing, as a result of which the arc is effectively blown and extinguished. In order to amplify this effect, the pressure space 12 and the return channel 13 may be lined with gas-liberating material. The pressure in the heating volume may additionally be increased by blast pistons concomitantly actuated by the switching drive.

Since, during switch-off, the arc roots are situated on the axial end faces of the first switching ring 4 and of the second switching ring 6 and on the tip of the switching pin 5, but the contact zones are in each case situated laterally, a large consumable reserve is available. In addition, the contact zones are not roughened by erosion.

Figure 2:
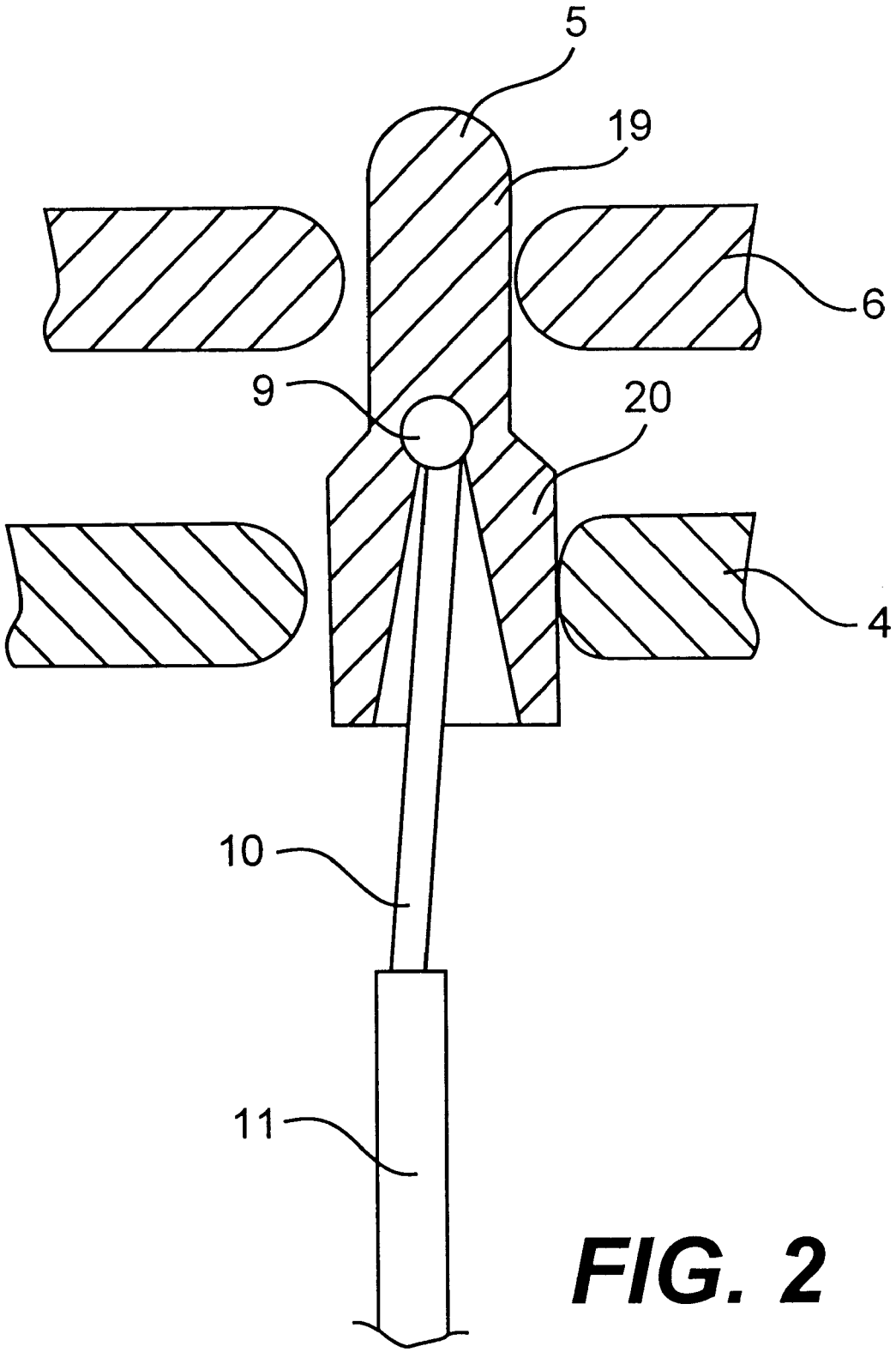
FIG. 2 shows an axial longitudinal section through the switching members in accordance with a modification of the embodiment according to FIG. 1, in the switched-on position.

The gas initially escapes only through the opening in the first switching ring 4, which opening is almost completely filled by the tip of the switching pin 5 in the switched-on position and is released shortly after the beginning of the switch-off movement. The opening in the second switching ring 6 does not become free until later, when the switching pin 5 is also withdrawn from it as the switch-off movement proceeds further. In contrast, both openings become free at the same time in the case of the design of the switching pin 5 according to FIG. 2. The diameter of the second switching ring 6 is somewhat greater than that of the first switching ring 4 and the switching pin 5 has a front portion 19, whose diameter approximately corresponds to that of the opening in the first switching ring 4. It merges in a step-like manner with a rear portion 20, whose diameter corresponds almost to the larger diameter of the second switching ring 6. In the switched-on position, the distance between the step separating the front portion 19 from the rear portion 20 and the second switching ring 6 corresponds to that between the tip of the switching pin 5 and the first switching ring 4, so that both openings—that in the second switching ring 6 partly—are released simultaneously, which allows the gas to flow away more rapidly and the arc to be blown in a more concentrated manner.

Instead of being connected to the rod 10 via a ball and socket joint, the switching pin 5 can also be connected via a hinge, with the result that the tilt axis oriented transversely with respect to the switching axis is spatially fixed.

Figure 3B:
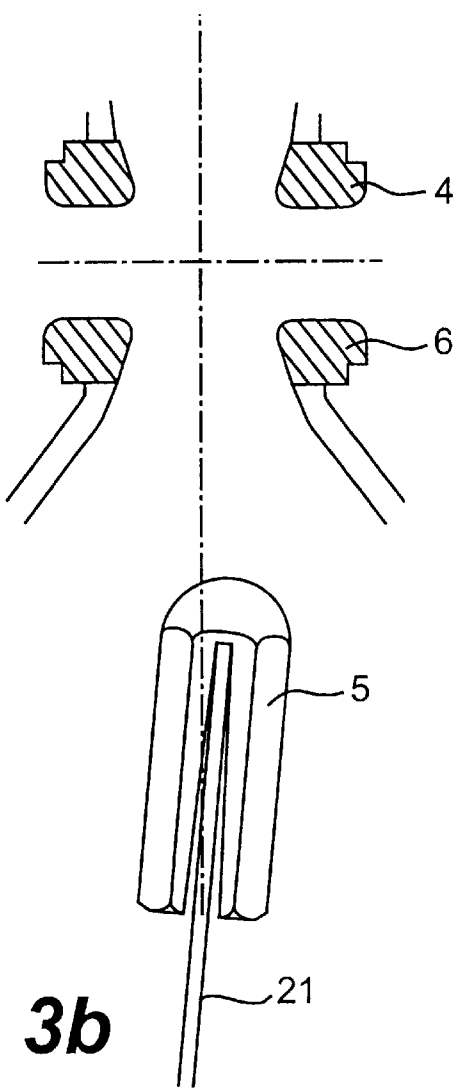
FIG. 3*b* shows an axial longitudinal section through the switching members of the consumable switching arrangement in accordance with the second embodiment of the invention, in the switched-off position.
Figure 3A:
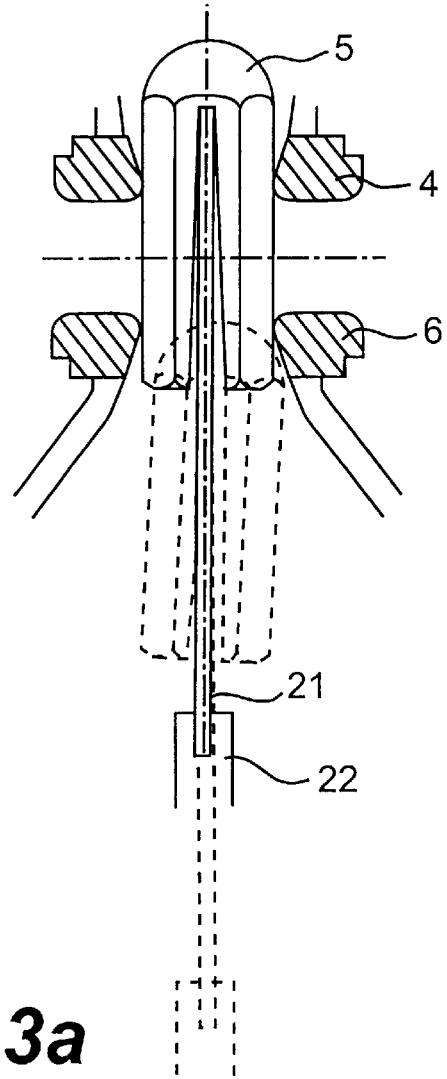
FIG. 3*a* shows an axial longitudinal section through the switching members of a consumable switching arrangement in accordance with a second embodiment of the invention, in the switched-on position and, represented by dashes, in an intermediate position.

In accordance with a second embodiment of the consumable switching arrangement according to the invention (FIGS. 3*a*, 3*b*), said second embodiment corresponding, incidentally, essentially to the first embodiment, the switching pin 5 is connected to the mount (not illustrated) via a leaf spring 21 and a rigid rod 22. The leaf spring 21 is rigidly connected both to the rod 22 and to the end of the switching pin 5 and is designed in such a way that the switching pin 5, when it is in its rest position assumed in the switched-off position (FIG. 3*b*), is likewise displaced laterally relative to the switching axis 1 and is inclined somewhat toward the same side, with the result that, in the switched-on position (FIG. 3*a*), it experiences a lateral deflection by the contact with the second switching ring 6 and, moreover, a rotary deflection by the contact with the first switching ring 4, the pivot point of said rotary deflection once again lying between the first switching ring 4 and the second switching ring 6, and is pressed against the inner sides of both switching rings by the elastic restoring forces of the leaf spring 21.

Figure 4A:
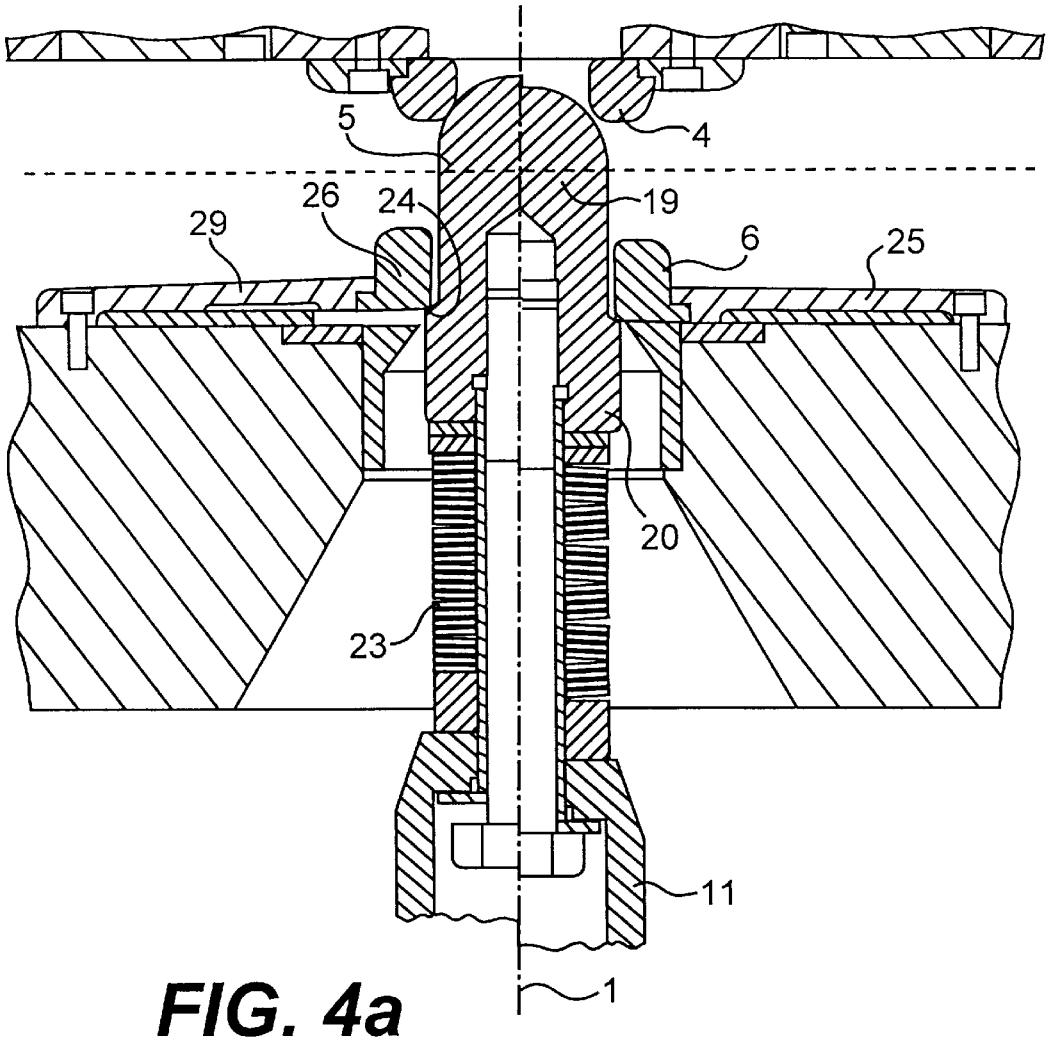
FIG. 4*a* shows an axial longitudinal section through a consumable switching arrangement in accordance with a third embodiment of the invention, in the switched-on position on the left and shortly before the switched-on position is reached on the right.
Figure 4B:
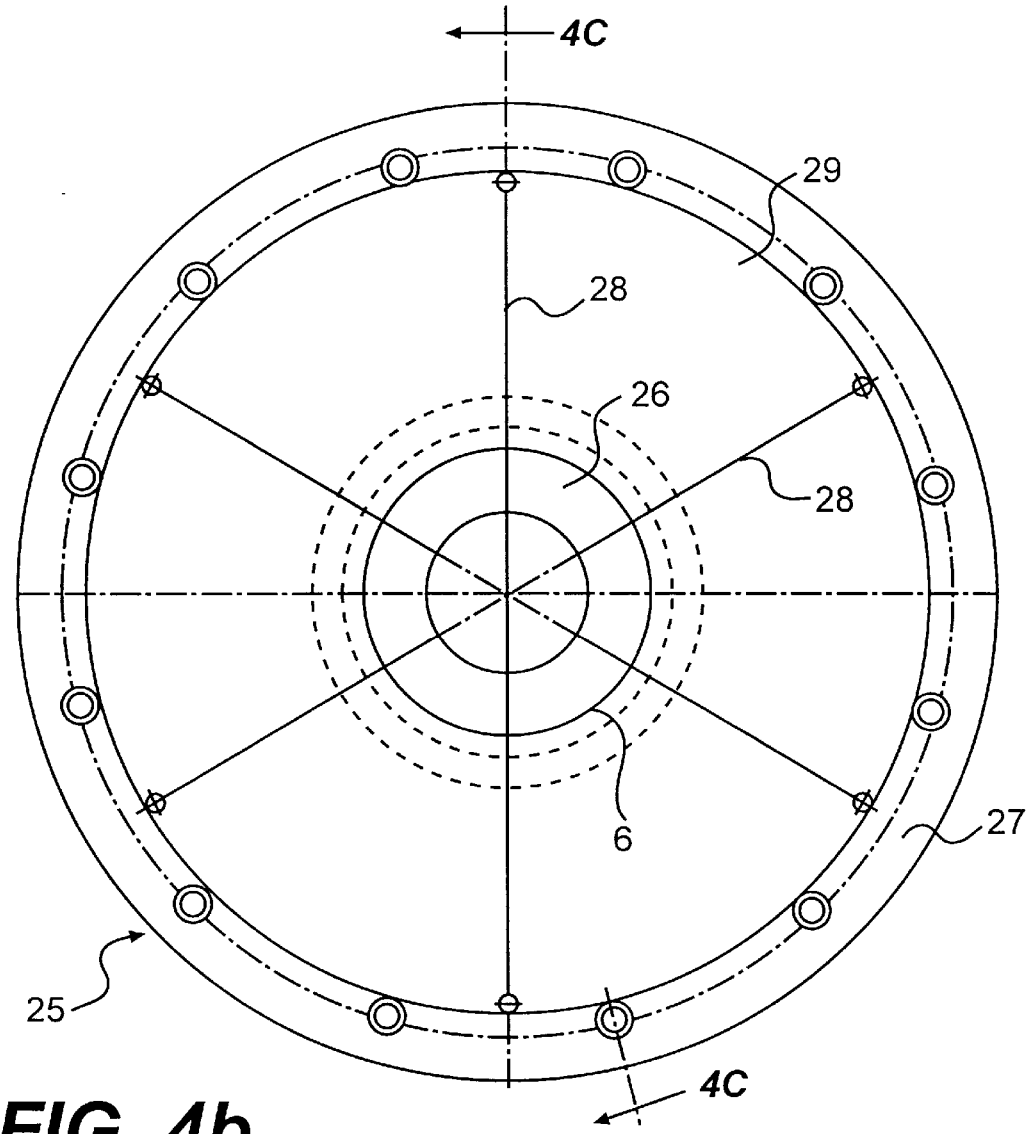
FIG. 4*b* shows an axial plan view of part of the consumable switching arrangement according to FIG. 4*a,*
Figure 4C:
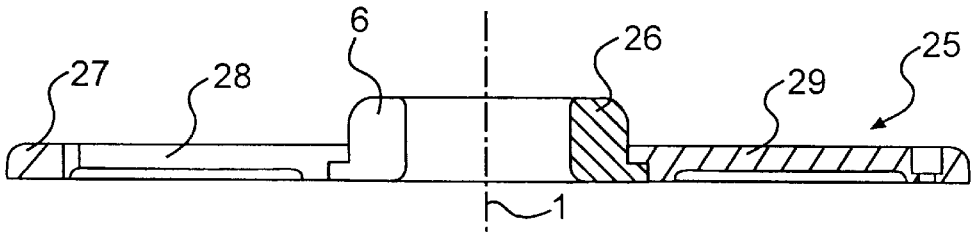
FIG. 4*c* shows a section along 4C—4C in FIG. 4*b,*

In accordance with a third embodiment of the consumable switching arrangement according to the invention, said third embodiment being illustrated in FIGS. 4*a*–4*c* and, incidentally, largely corresponding to the first embodiment, the switching pin 5 is mounted such that it can be displaced axially on the mount 11 and is supported on the same by means of an axially compressible disc spring assembly 23. The diameter of a front portion 19 of the switching pin 5 is greater than that of the opening in the first switching ring 4, with the result that, in the switched-on position, its hemispherical tip bears all around on the inner edge of the end of the first switching ring 4 and presses against it with contact forces applied by the restoring forces of the axially compressed disc spring assembly 23. The front portion 19 is adjoined, via a shoulder 24, by a rear portion 20 having a larger diameter.

The second switching member once again comprises a second switching ring 6 in addition to the switching pin 5, said second switching ring bordering on the inner edge of an annular disc 25. The second switching ring 6 is divided into six sectors 26, and so is the annular disc 25, which has six radial slots 28 proceeding from the inner edge and continuing as far as a circumferential outer ring 27, said radial slots dividing said annular disc into just as many sectors 29. The annular disc 25 may be composed of high-conductivity resilient-elastic material, e.g. a hardenable copper alloy such as CuCrZr or CuBe, so that the sectors 26 of the second switching ring 6 can be deflective with elastic deformation of the sectors 29 of the annular disc 25 that support them, in the axial direction. Since that part of the front portion 19 of the switching pin 5 which lies between the first switching ring 4 and the shoulder 24 is somewhat shorter than the distance between the first switching ring 4 and the second switching ring 6, in the switched-on position the front abutting surface of the shoulder 24 presses against the sectors 26 of said second switching ring and deflects them somewhat, with the result that the necessary contact forces are applied by the restoring forces of the elastically deformed sectors 29 in this case as well.

In the case of the embodiments portrayed above, the switching pin is designed to be rigid and, preferably, solid and is mounted elastically and, in the switched-on position, is deflected by the contact with the first switching ring and the second switching ring, with the result that elastic restoring forces act on it from the mount, said restoring forces providing for the necessary contact forces between the switching pin and the switching rings.

In the case of the embodiments explained below, the switching pin itself comprises two or more parts in the region of the contact zone or zones, which parts, at least in some instances, can be moved in a radially limited manner and are spread apart by mechanical or electromagnetic forces, so that they press against the inner sides of the switching rings with contact surfaces pointing outward.

Figures 5A, 5B:
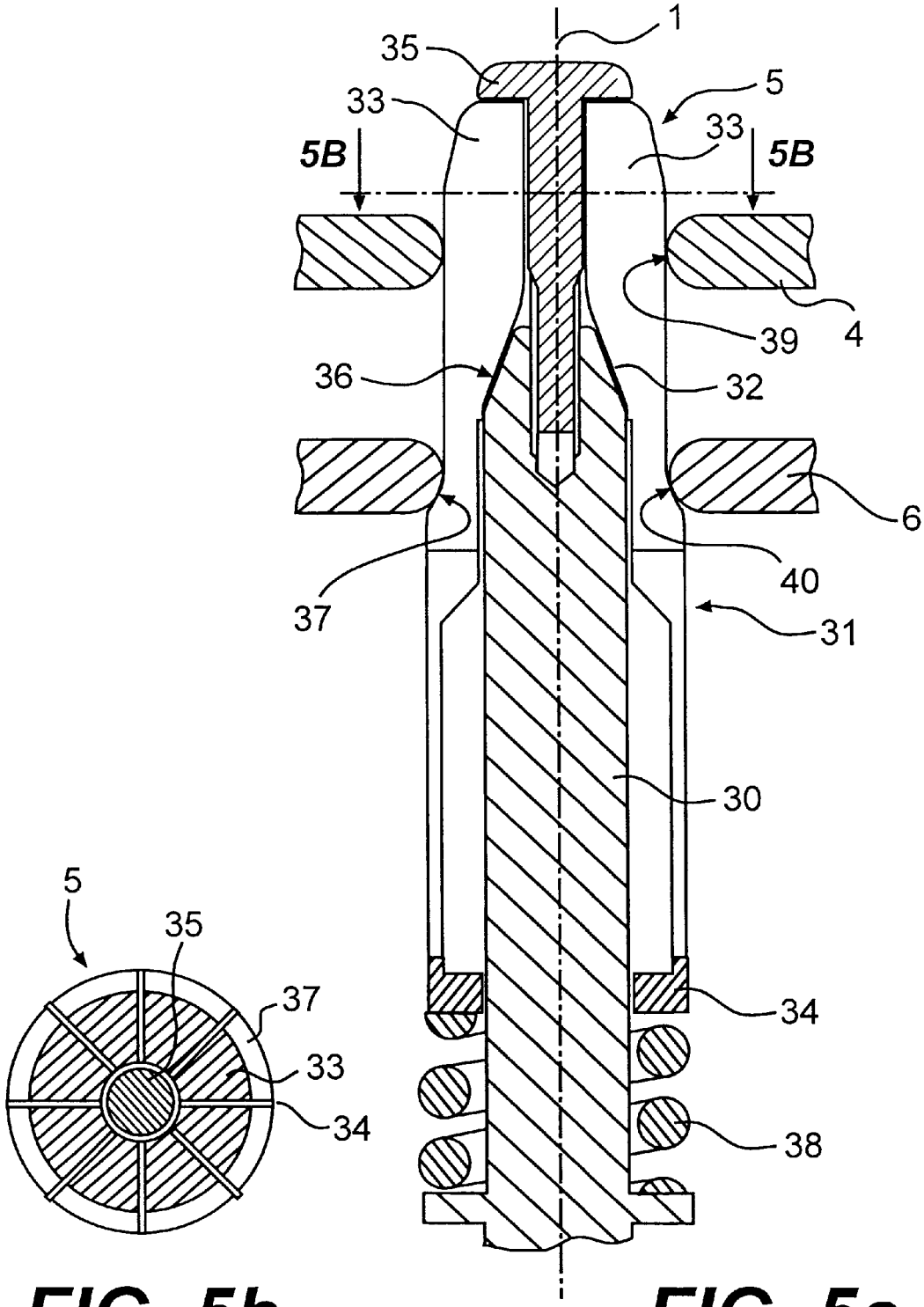
FIG. 5*a* shows an axial longitudinal section through switching members of a consumable switching arrangement in accordance with a fourth embodiment of the invention, in the switched-on position.
FIG. 5*b* shows a section through the switching pin along 5B—5B in FIG. 5*a,*

In accordance with a fourth embodiment of the consumable switching arrangement according to the invention, said fourth embodiment being illustrated in FIGS. 5*a*, 5*b* and, incidentally, essentially corresponding to the first embodiment, the switching pin 5 is preferably coaxial with the first switching ring 4 and the second switching ring 6, with the result that the switching pin axis coincides with the switching axis 1. Said switching pin has a central support 30, which is connected to the mount (not illustrated) and is surrounded by a sleeve 31. The support 30 is designed as a cylindrical mandrel which narrows at the tip into a wedge surface 32 which is directed in a slanted manner toward the tip of the switching pin and is circumferential in the shape of a cone envelope. The sleeve 31 surrounds the tip of the support 30 with eight contact members distributed over its periphery, which contact members are designed as elongate contact fingers 33 made of erosion-resistant material and separated by slots and are held together by a continuous ring 34 at the rear end of the sleeve 31. The sleeve 31 is fixedly held on the support 30 by means of a fixing screw 35, which is screwed into the tip of the support 30 and whose head projects laterally above the tips of the contact fingers 33.

On their inner sides, the contact fingers 33 have spreading surfaces 36, which bear against the wedge surface 32 of the support 30 in the switched-on position. On their outer sides, the contact fingers 33 each have a step forming a stop surface 37, which bears against the second switching ring 6 in the switched-on position. An elastic force directed toward the tip of the switching pin is applied to the sleeve 31 by a helical spring 38 supported on the support 30. The fixing screw 35, or at least its head, may be composed once again of erosion-resistant material, while the sleeve 31 may be produced from high-conductivity resilient-elastic material.

In the switched-off position, the contact fingers 33 are in their front end position, under the action of the helical spring 38. Just before the end of the switch-on movement, the stop surface 37 butts against the second switching ring 6, which stops the movement of the contact fingers 33 in a position in which the wedge surface 32 and the spreading surfaces 36 lie approximately in the middle between the first switching ring 4 and the second switching ring 6. Under the compression of the helical spring 38, the support 30 is additionally advanced by a short amount, the wedge surface 32 butting against the spreading surfaces 36 and the contact fingers 33 pressing radially outward with their contact surfaces 39 and 40, which form a first and a second contact zone, against the inner sides both of the first switching ring 4 and of the second switching ring 6.

At the beginning of the switch-off movement, the support 30 is pulled back, while the sleeve 31 is still stationary under the action of the helical spring 38 and also of the friction between the contact surfaces 39 and 40 and the inner sides of the first switching ring 4 and of the second switching ring 6, respectively. As a result, the wedge surface 32 is pulled back somewhat from the spreading surfaces 36 and the spreading of the contact fingers 33 outward is released. The switching pin 5 can then easily be pulled back.

By virtue of the fact that the contact forces are generated only when the contact fingers 33 have already come to a standstill in the switched-on position and are canceled again before their switch-off movement begins, they do not impede the movement. The friction between the switching pin 5, on the one hand, and the first switching ring 4 and the second switching ring 6, on the other hand, is slight during the switch-on and -off movement and, consequently, so, too, are the driving forces to be applied by the switching drive.

Figures 6A, 6B:
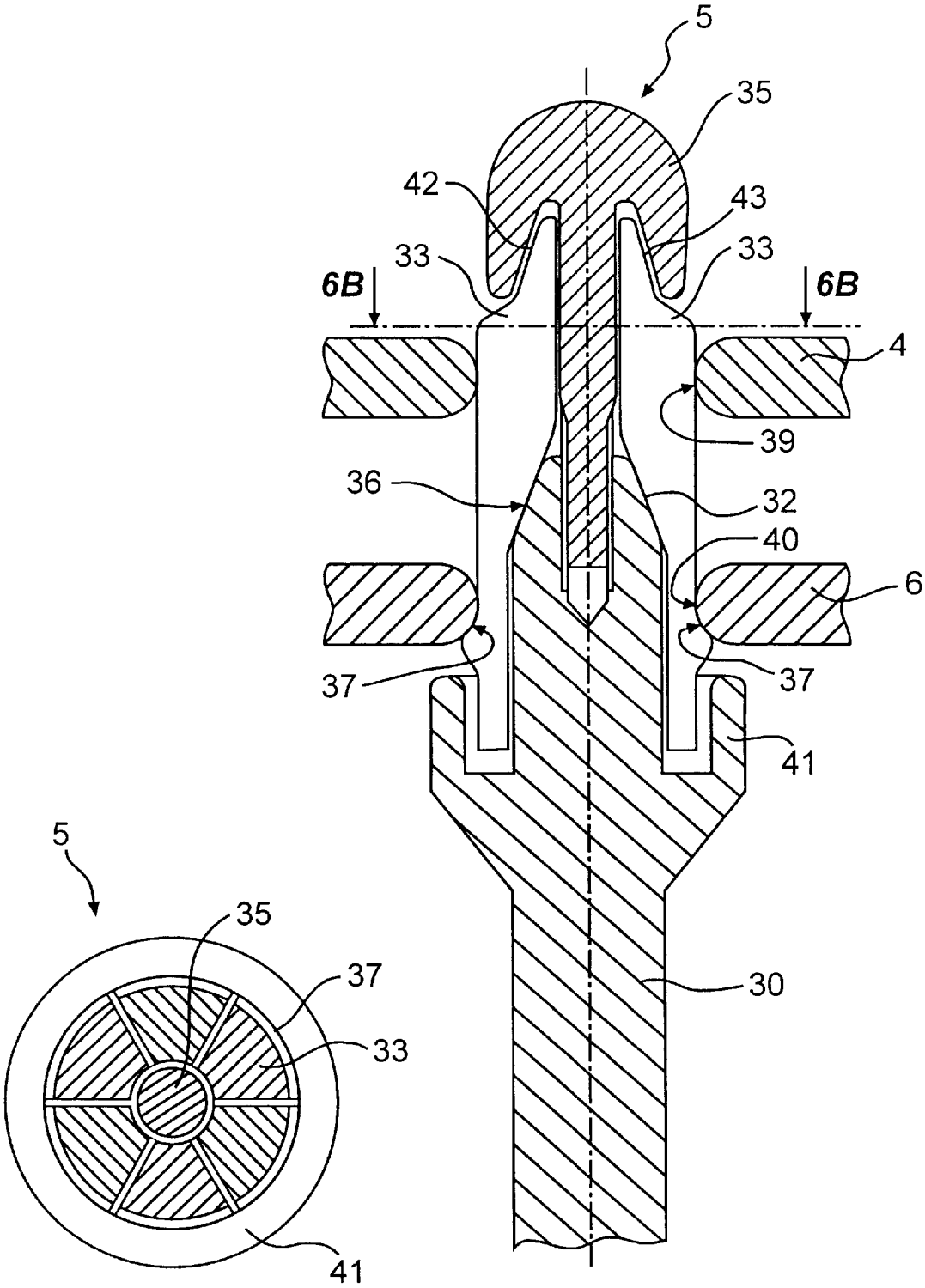
FIG. 6*a* shows an axial longitudinal section through switching members of a consumable switching arrangement in accordance with a fifth embodiment of the invention.
FIG. 6*b* shows a section through the switching pin along 6B—6B in FIG. 6*a,*

In accordance with a fifth embodiment of the consumable switching arrangement according to the invention, said fifth embodiment being very similar to the fourth, the six contact fingers 33 in this case are not interconnected. Note FIGS. 6*a* and 6*b*. They are held together by a holding ring 41 on the support 30, which surrounds the same at a distance. The fixing screw 35 is designed like a cap with a pressing surface 42, which points in a slanted manner toward the mount, that is to say rearward, is circumferential in the shape of a cone envelope and, during the switch-off movement, presses against corresponding compression surfaces 43 on the front ends of the switching fingers 33, with the result that the same are pressed radially inward there. A spring element which acts upon the switching fingers 33 with a force directed toward the tip of the switching pin 5 has been dispensed with in this case. The inertia of the contact fingers 33 at the jerky beginning of the switch-off movement suffices to release the spreading of said fingers.

The parts of the switching pin can also be spread apart by electromagnetic forces instead of by mechanical forces. The repulsion between antiparallel currents or the attraction between parallel currents is utilized in this case. Since these forces, just like the contact lift-off forces, increase as the current intensity rises, the corresponding embodiments afford the advantage that appropriate compensation of the contact lift-off forces is ensured over a wide range of current intensities.

Figure 7A:
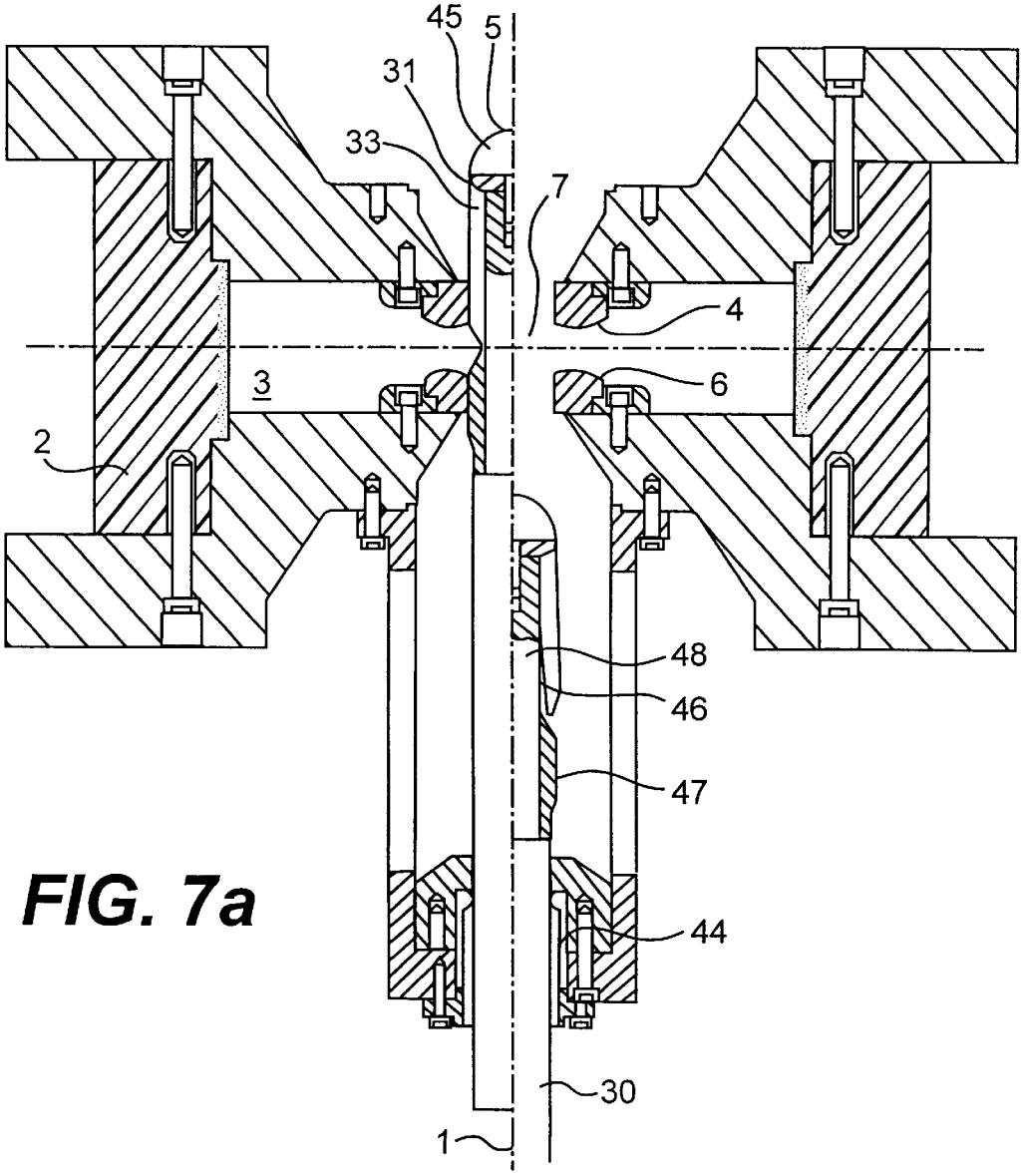
FIG. 7*a* shows an axial longitudinal section through a consumable switching arrangement in accordance with a sixth embodiment of the invention, in the switched-on position on the left and in the switched-off position on the right.
Figure 7C:
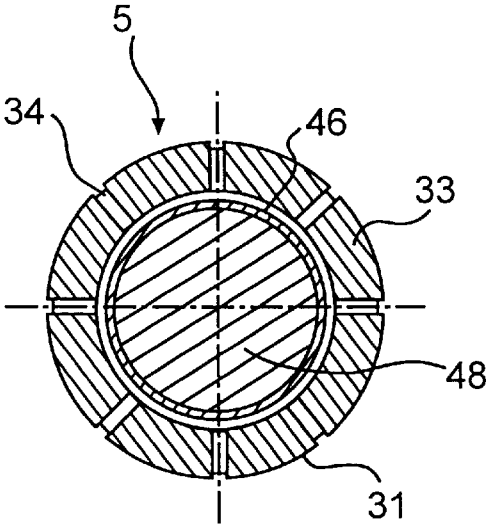
FIG. 7*c* shows a section through the switching pin along 7C—7C in FIG. 7*b,*
Figure 7B:
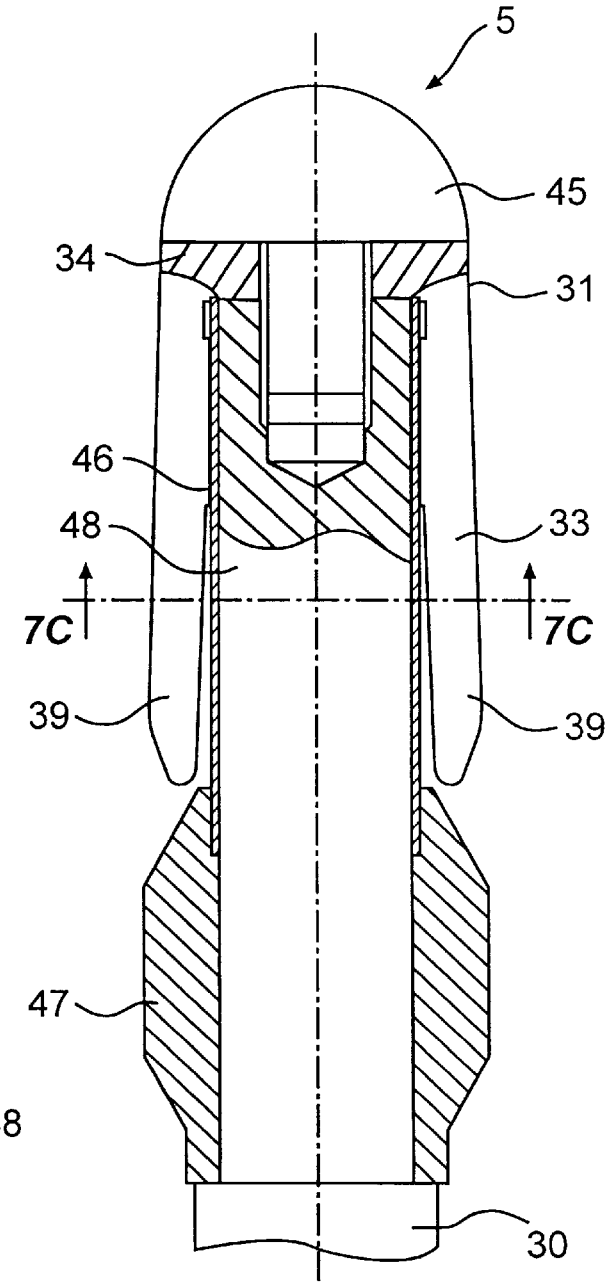
FIG. 7*b* shows an axial longitudinal section through the switching pin in accordance with the sixth embodiment of the invention.

A sixth embodiment of the consumable switching arrangement according to the invention, said sixth embodiment being illustrated in FIGS. 7*a*–7*c*, corresponds to the first embodiment in terms of its fundamental structure, although with a number of simplifications. For this reason, the parts that remain the same are not described again. The switching pin 5 is surrounded by a sliding tulip 44, which is arranged somewhat in front of the mount (not illustrated) and, just like the second switching ring 6, is connected to the second electrical terminal. Although the contact fingers of the sliding tulip 44 are subjected to high mechanical loading by electromagnetic forces during the switch-off and -on operations, they can nevertheless be designed absolutely for sufficient strength and in terms of ensuring sufficient contact with the switching pin 5, since no erosion occurs on said contact fingers.

The switching pin 5 once again has a central support 30 designed as a mandrel connected to the mount, screwed into the tip of which support is a cap 45, which is made of erosion-resistant material and fixedly clamps a sleeve 31 made of high-conductivity resilient-elastic material, in particular a ring 34 on the front end of the same. A group of eight contact members proceeds from the ring 34, which contact members are arranged at the same level on the switching pin 5, are separated by slots, are designed once again as elongate contact fingers 33 and in this case project rearward, surrounding the support 30 in a parallel manner. From the cap 45 to a point beyond the ends of the contact fingers 33, the support 30 is surrounded by an insulating-material sleeve 46, which is overlapped by a thicker insulating-material ring 47.

In the switched-on position, the contact surfaces 39 situated just before the ends of the contact fingers 33 touch the inner side of the first switching ring 4. The switching pin 5 largely fills the opening therein, just like that in the second switching ring 6 in which the insulating-material ring 47 is situated. The current path runs from the first switching ring 4 via the contact surfaces 39 into the contact fingers 33 and through the same to the ring 34 and further through the support 30 and via the sliding tulip 44. The frontmost part of the support 30 surrounded by the contact fingers 33 in this case forms a conductor 48, which carries a current which is antiparallel with respect to the current direction in the contact fingers 33 to which said conductor is electrically conductively connected at a junction point formed by the ring 34. As a result of the electromagnetic repulsion caused in this way between the conductor 48 and the contact fingers 33, the latter are spread outward and their contact surfaces 39 are pressed against the inner side of the first switching ring 4. The contact forces generated in this way are, just like the contact lift-off forces opposing them, all the greater the higher the current intensity is.

During the first phase of the switch-off movement, that region of the switching pin which is in contact with the first switching ring 4 is displaced in the direction of the cap 45, with the result that the length of the antiparallel current paths decreases comparatively rapidly, the contact forces decreasing at the same time. When the switching pin 5 is pulled from the first switching ring 4, an arc forms between the latter and the cap 45. When the cap 45 passes the second switching ring 6, the arc root jumps across from said cap to said second switching ring, with the result that the arc then burns between the first switching ring 4 and the second switching ring 6. It is blown from the heating volume 3 and extinguished upon the next zero crossing.

Figure 8:
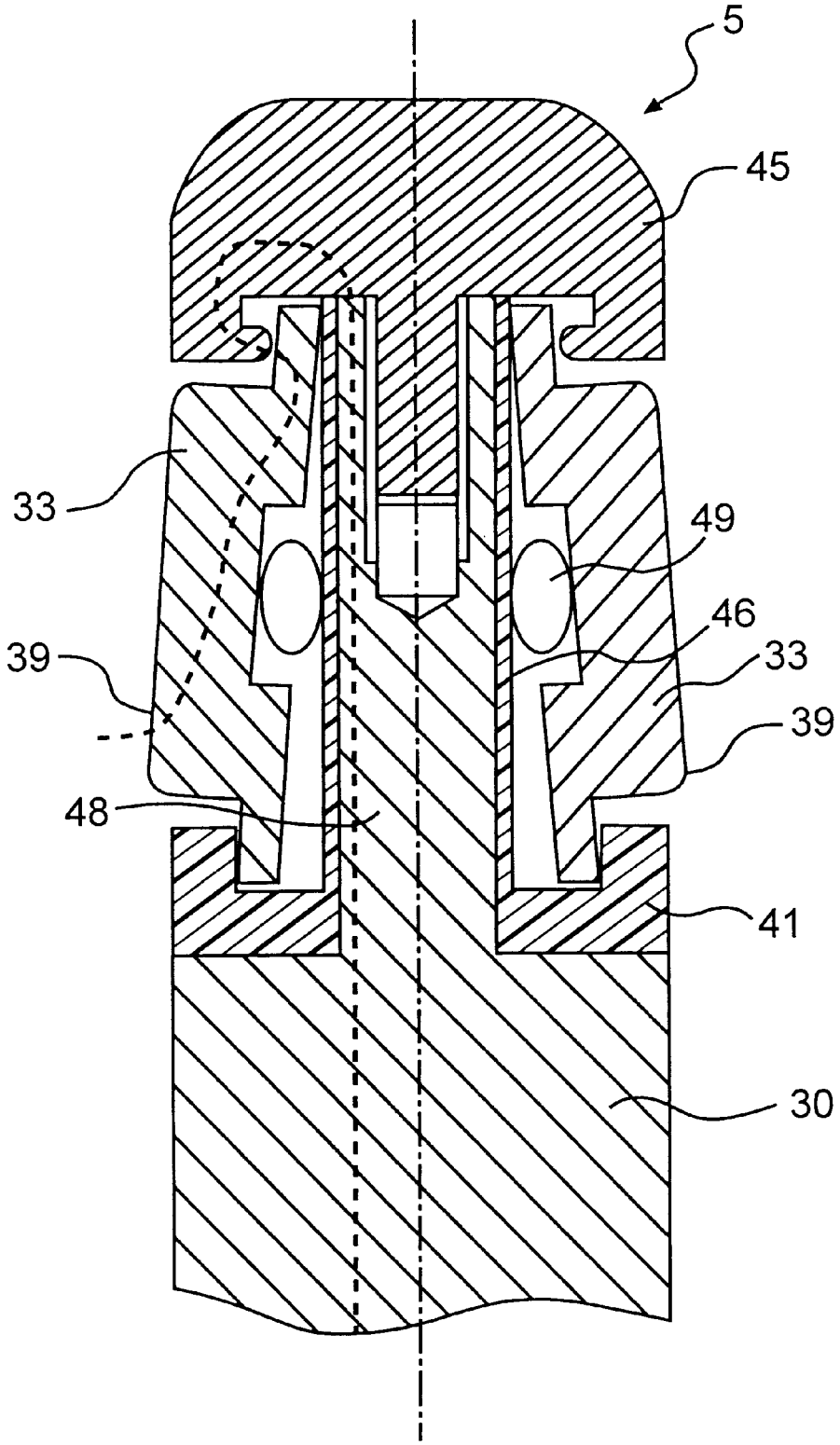
FIG. 8 shows an axial longitudinal section through a switching pin of a consumable switching arrangement in accordance with a seventh embodiment of the invention.

In accordance with a seventh embodiment of the consumable switching arrangement according to the invention (FIG. 8), said seventh embodiment corresponding, incidentally, to the sixth embodiment, the contact fingers 33 are mounted on that portion of the support 30 which forms the conductor 48 by a collar-type projection of the cap 45 engaging over the front ends of said contact fingers and a holding ring 41, which is integral with the insulating-material sleeve 46, engaging over the rear ends of said contact fingers. By means of compressed leaf springs 49 supported on the insulating-material sleeve 46 and acting approximately centrally on the inner sides of the contact fingers 33, the same are pressed radially outward, with the result that, in the switched-on position, the electromagnetic forces during the application of the contact forces between the contact surfaces 39 on the outer side of the contact fingers 33 and the inner side of the first contact ring 4 are supported by elastic forces.

Figure 9:
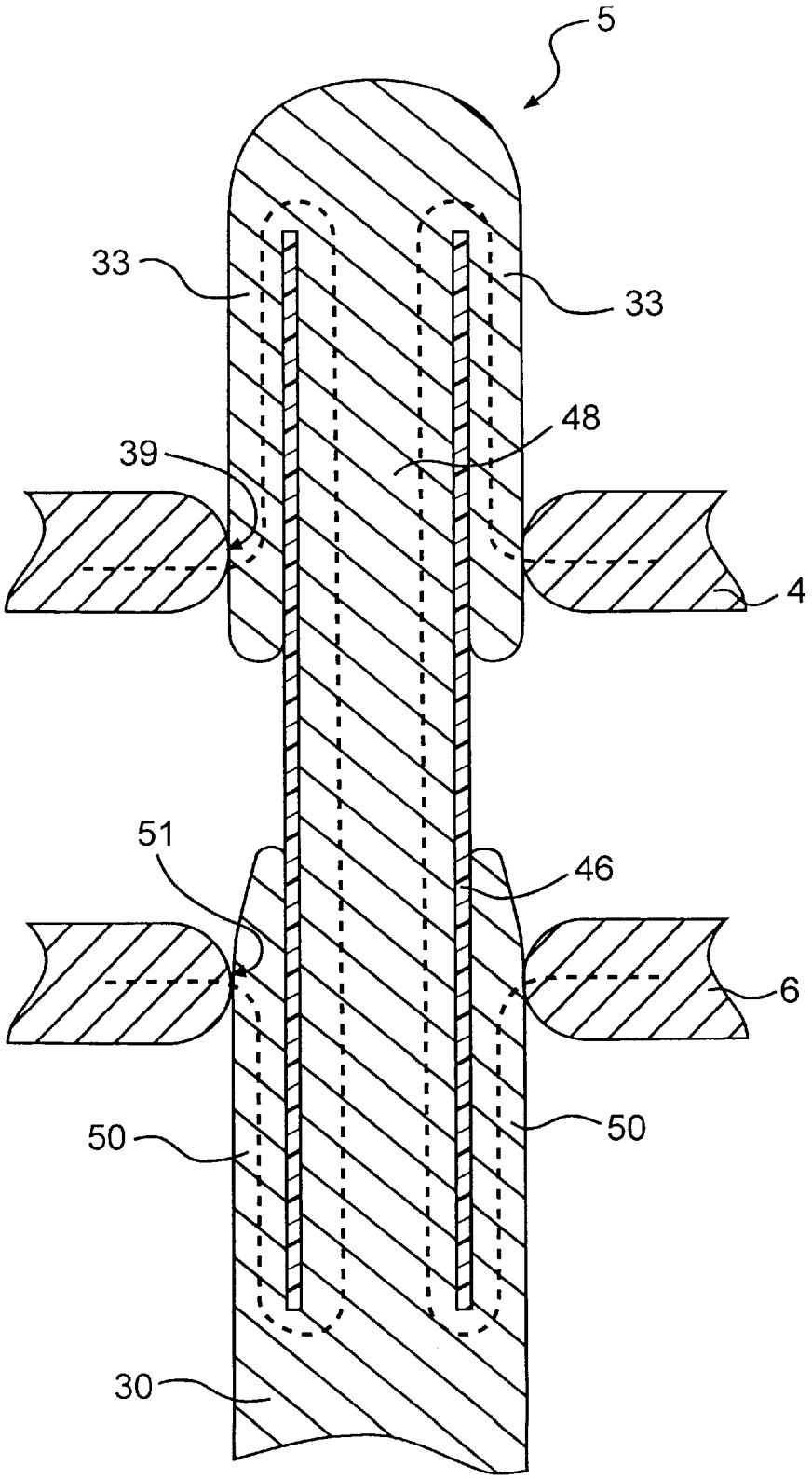
FIG. 9 shows an axial longitudinal section through switching members of a consumable switching arrangement in accordance with an eighth embodiment of the invention.
Figure 10A:
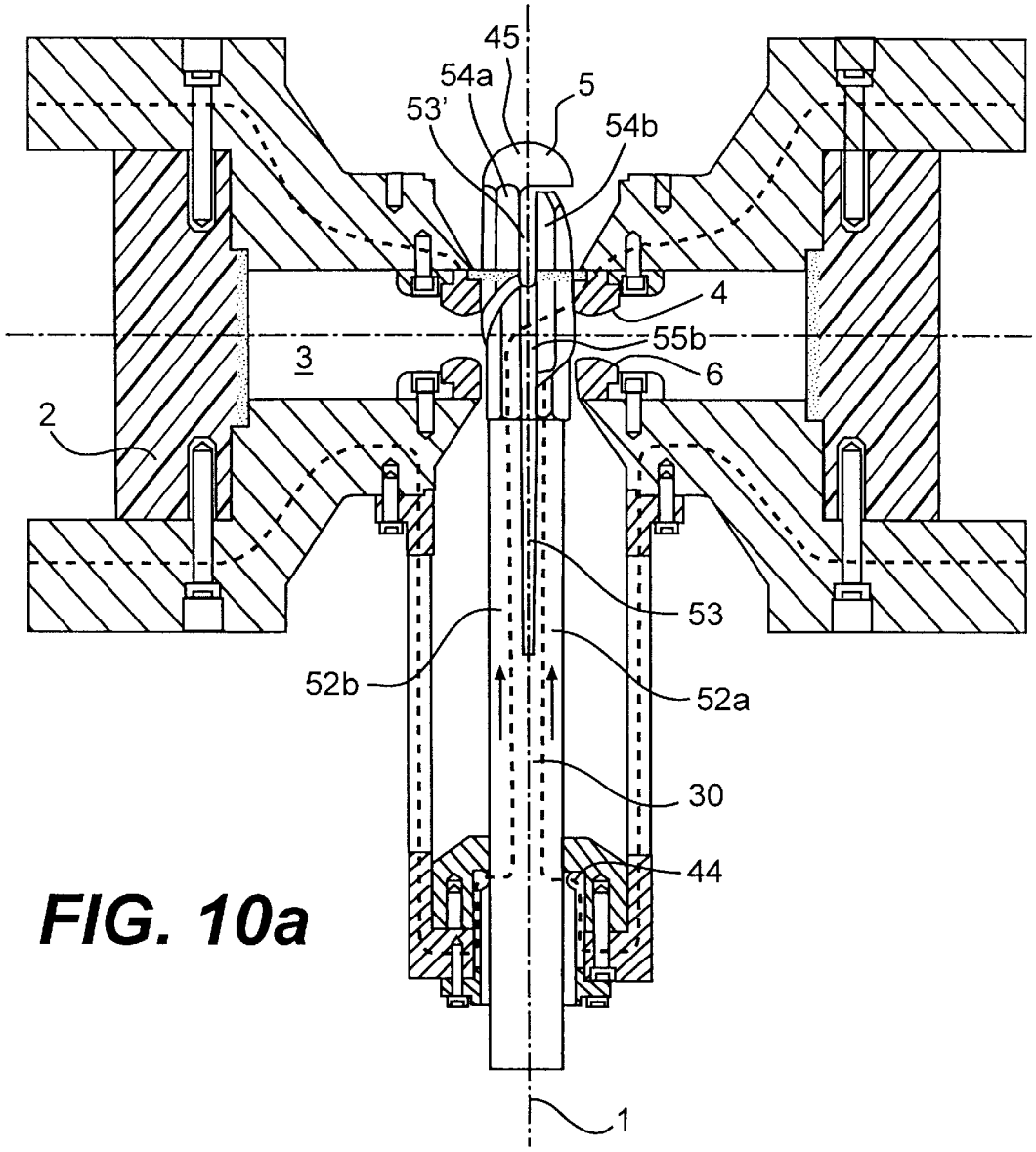
FIG. 10*a* shows an axial longitudinal section through a consumable switching arrangement in accordance with a ninth embodiment of the invention, in the switched-on position.
Figure 10B:
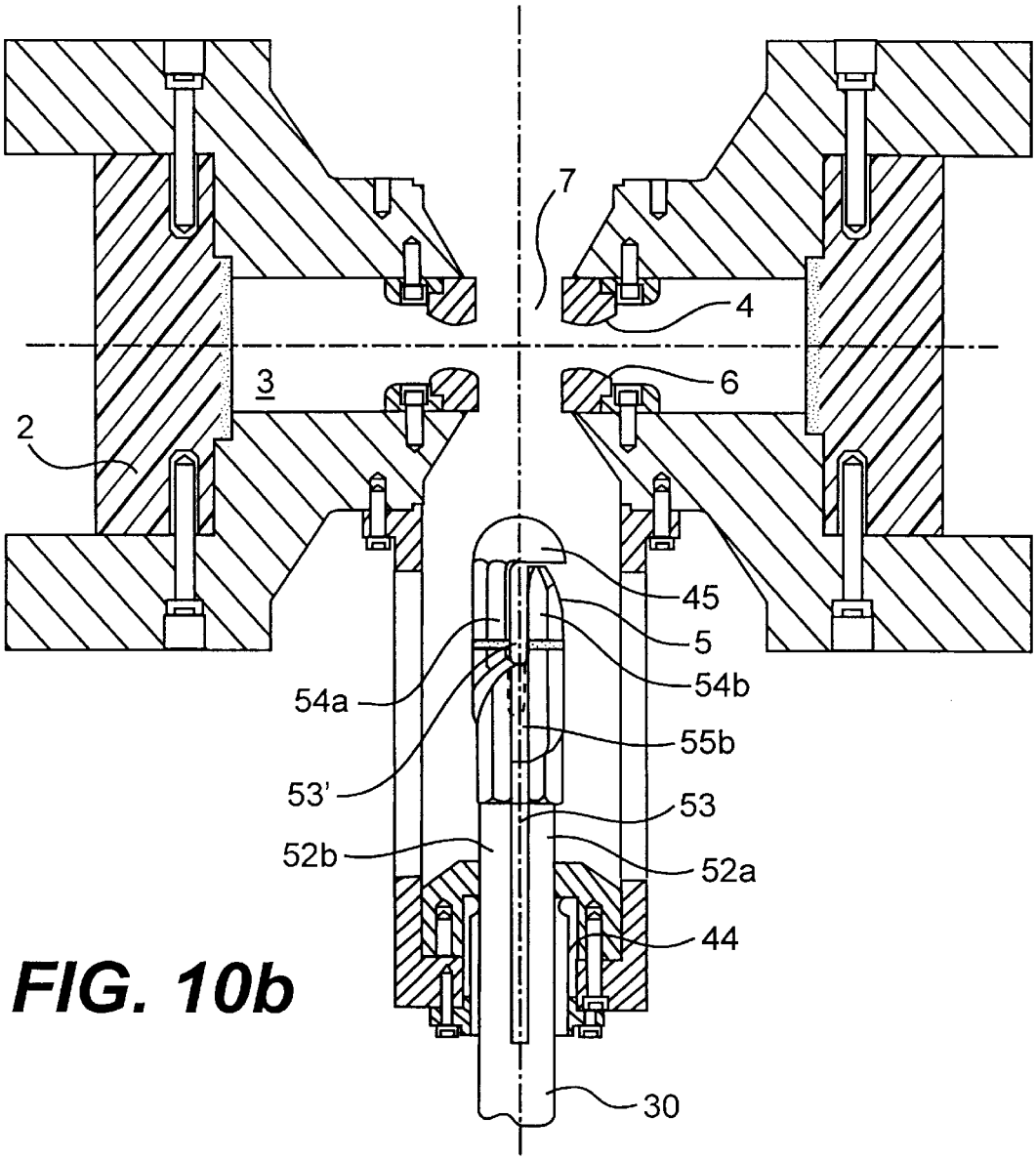
FIG. 10*b* shows an axial longitudinal section through the consumable switching arrangement in accordance with the ninth embodiment of the invention, in the switched-off position.
Figure 10H:
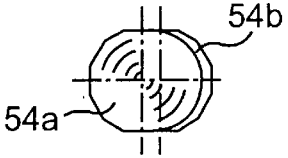
FIG. 10*h* shows an axial plan view of the tip of the switching pin in accordance with FIG. 10*d*.
Figure 10G:
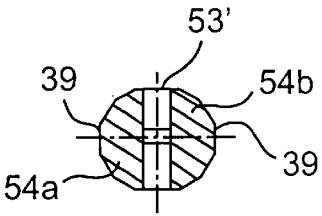
FIG. 10*g* shows a cross section through the switching pin along 10G—10G in FIG. 10*d*.
Figure 10F:
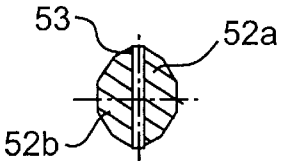
FIG. 10*f* shows a cross section through the switching pin along 10F—10F in FIG. 10*d*.
Figure 10E:
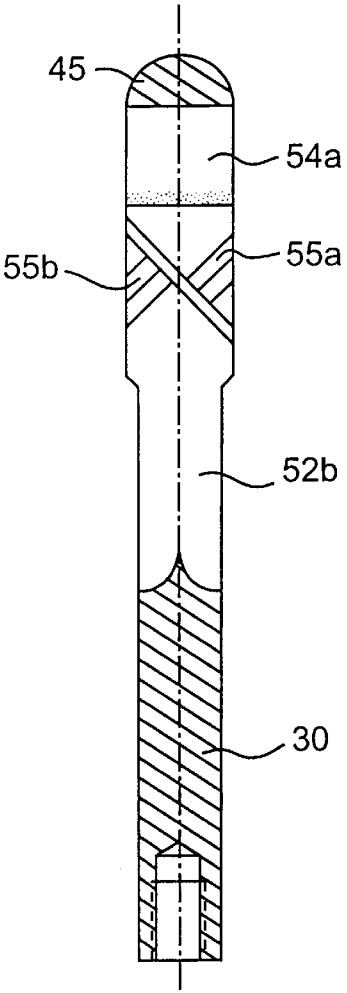
FIG. 10*e* shows a longitudinal section through the switching pin along 10E—10E in FIG. 10*d*.
Figure 10D:
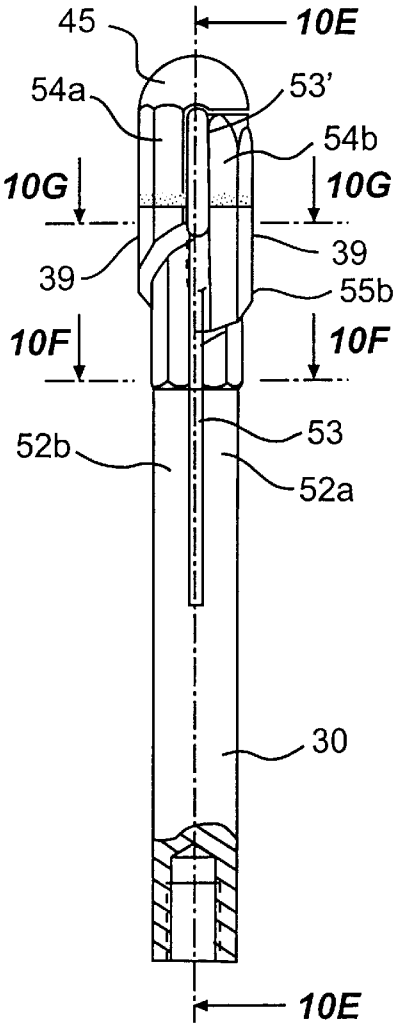
FIG. 10*d* shows a lateral plan view of the switching pin in accordance with FIG. 10*c* after having been rotated through 90°.
Figure 10C:
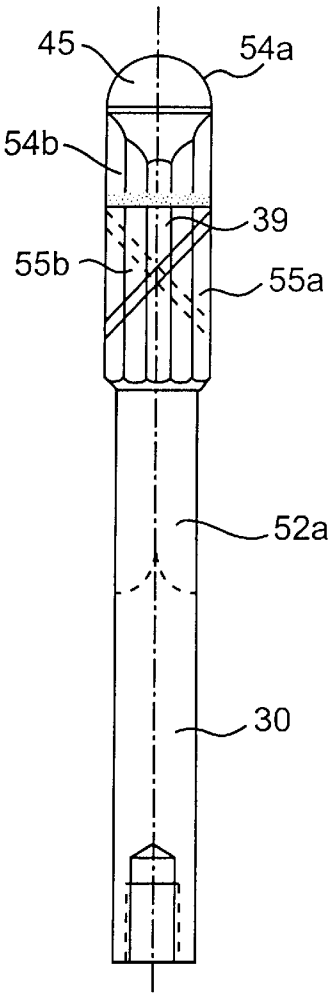
FIG. 10*c* shows a lateral plan view of the switching pin in accordance with the ninth embodiment of the invention.
Figure 11B:
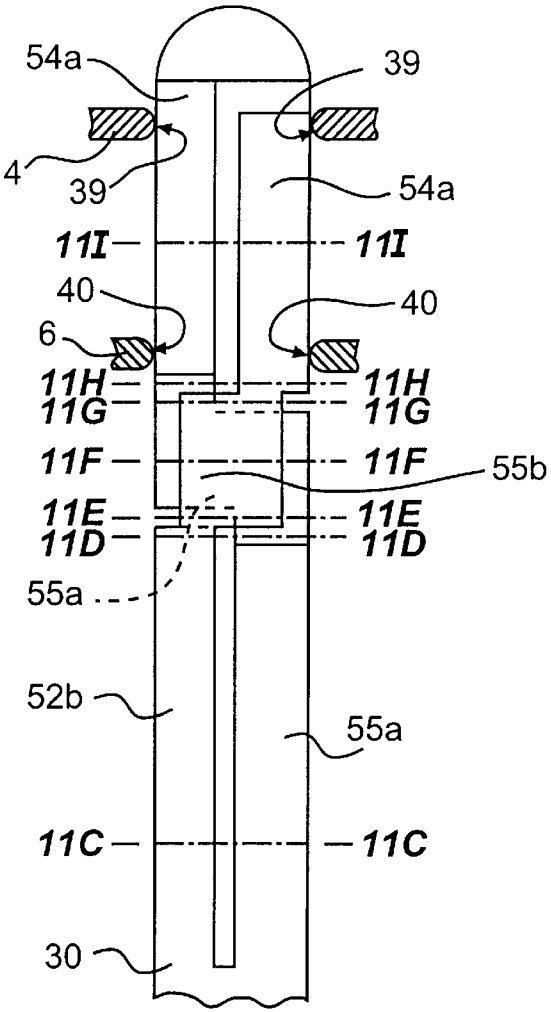
FIG. 11*b* shows a longitudinal section through the switching members of the consumable switching arrangement, which longitudinal section is rotated through 90° relative to FIG. 11*a*.
Figure 11A:
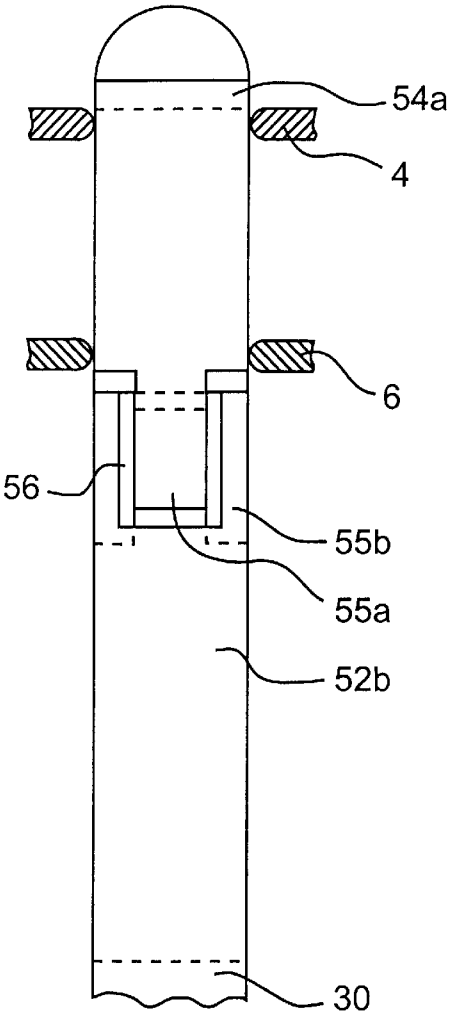
FIG. 11*a* shows an axial longitudinal section through switching members of a consumable switching arrangement in accordance with a tenth embodiment of the invention.
Figure 11I:
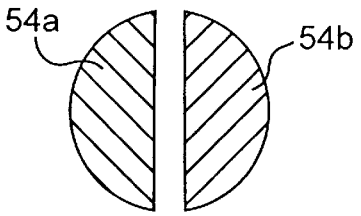
FIG. 11*i* shows a cross section through the switching pin along 11I—11I in FIG. 11*b*.
Figure 11H:
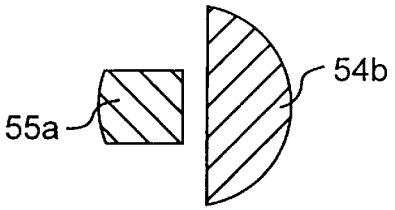
FIG. 11*h* shows a cross section through the switching pin along 11H—11H in FIG. 11*b*.
Figure 11G:
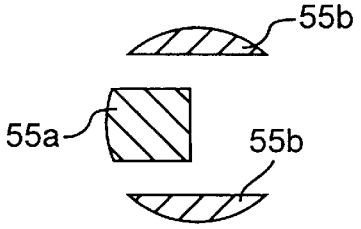
FIG. 11*g* shows a cross section through the switching pin along 11G—11G in FIG. 11*b*.
Figure 11F:
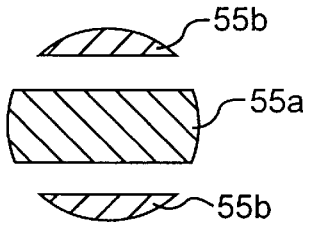
FIG. 11*f* shows a cross section through the switching pin along 11F—11F in FIG. 11*b*.
Figure 11E:
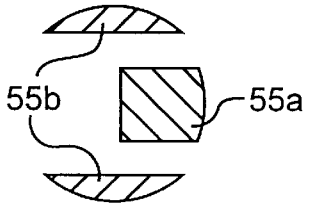
FIG. 11*e* shows a cross section through the switching pin along 11E—11E in FIG. 11*b*.
Figure 11D:
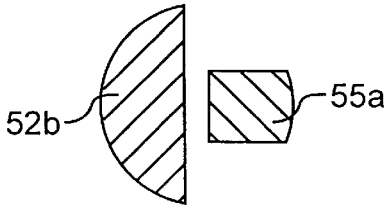
FIG. 11*d* shows a cross section through the switching pin along 11D—11D in FIG. 11*b*.
Figure 11C:
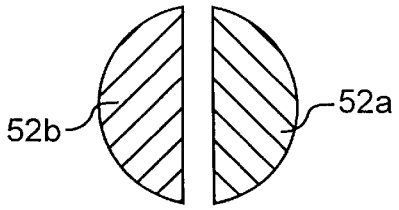
FIG. 11*c* shows a cross section through the switching pin along 11C—11C in FIG. 11*b*.

In the case of an eighth embodiment illustrated in FIG. 9, the switching pin 5 is made of high-conductivity resilient-elastic material with, similarly to the sixth and seventh embodiments, a first group of contact fingers 33, which adjoin the tip of the switching pin 5 such that they can be bent elastically outward and point rearward. In a similar manner, contact fingers 50 of a second group, which is offset relative to the first group, adjoin the support 30, with the differences that they commence at a location which is offset relative to the second switching ring 6 toward the mount (not illustrated) and are directed forward toward the tip of the switching pin. That portion of the support 30 which serves as the conductor 48 connecting the point of commencement of the contact fingers 50 of the second group to that of the contact fingers 33 of the first group is once again surrounded by an insulating-material sleeve 46 insulating it from the contact fingers 33, 50.

In the switched-on position, the current path—the switching pin 5 is insulated and connected to the electrical terminals merely via the switching rings—runs from the first switching ring 4 via the contact surfaces 39 into the contact fingers 33 of the first group, along the same to the tip of the switching pin 5, which constitutes the junction point with respect to the conductor 48, then back through this as far as the second junction point at the points of commencement of the contact fingers 50 of the second group and then further through these toward the tip of the switching pin and via their contact surfaces 51 into the second switching ring 6. Thus, the current path runs through the conductor 48, on the one hand, and through the contact fingers 33 of the first group as well as the contact fingers 50 of the second group, on the other hand, in each case in antiparallel fashion, with the result that, in the switched-on position, the contact fingers 23, 50 of the two groups are pressed radially outward against the inner sides of the first switching ring 4 and of the second switching ring 6, respectively, by the electromagnetic forces acting between the currents.

In the case of the ninth embodiment of the consumable switching arrangement according to the invention, said ninth embodiment being illustrated in FIGS. 10*a*–10*h* and corresponding, incidentally, to the sixth embodiment, the attraction between parallel currents is utilized for the purpose of applying the necessary contact forces. The switching pin 5 has two elastically flexible, parallel extensions 52*a, b*, which adjoin the end of the support 30 and are separated by a slot 53. At its end, each of the extensions 52*a, b* has a contact member 54*a* and 54*b*, respectively, with a contact surface 39 for making contact with the inner surface of the first switching ring 4, to which it is connected via a connecting element 55*a* and 55*b*, respectively, in such a way that each of the contact members 54*a*, 54*b* is offset by 180° relative to the respective extension 52*a* and 52*b* with regard to a switching-pin axis, which in this case coincides with the switching axis 1. The connecting elements 55*a*, 55*b* are designed as short screw portions forming half a thread. The contact members 54*a*, 54*b* are separated from one another by an extension 53' of the slot 53. Taken together, they have a polygonal, in the example dodecagonal, cross section. The first contact member 54*a* supports an approximately hemispherical cap 45 made of erosion-resistant material, said cap forming the tip of the switching pin 5. Apart from this difference, the parts of the switching pin 5 which respectively comprise an extension 52*a* or 52*b*, a respective connecting element 55*a* or 55*b* and a respective contact member 54*a* or 54*b* and are produced integrally with the support 30 from high-conductivity resilient-elastic material correspond to one another completely.

In the switched-on position (illustrated in FIG. 10*a*) in which the contact members 54*a*, 54*b* are pressed somewhat against one another by the contact with the first switching ring 4 and the extensions 55*a*, 55*b* are correspondingly spread apart, with the result that the contact surfaces 39 are already pressed against the inner side of the first switching ring 4 by elastic restoring forces, the current path runs via the latter and the contact surfaces 39 into the contact members 54*a*, 54*b*, through the same and the connecting elements 55*a*, 55*b*, the extensions 52*a*, 52*b* and a portion of the support 30 and further via the sliding tulip 44. The second switching ring 6 does not touch the switching pin 5. The two comparatively long extensions 52*a, b* carry parallel currents and are thereby pulled toward one another. The contact members 54*a*, 54*b*, which are connected to them and offset by 180° relative to them, are thereby forced apart and their contact surfaces 39 are pressed to an even greater extent against the inner side of the first switching ring 4. As a result of the polygonal cross section of the switching pin 5 in the region of the contact surfaces 39, it always touches the first switching ring 4 at at least four locations.

Shortly after the beginning of the switch-off movement, the contact members 54*a*, 54*b* also touch the second switching ring 6 and thus at least partly short-circuit the current path outlined above. As a result, the electromagnetic attraction between the extensions 52*a* and 52*b* is also reduced and so too are the contact forces engendered by the same. Therefore, the further withdrawal of the switching pin 5 is not impeded by excessively high friction forces. When the tip of the switching pin 5 is pulled from the opening in the first switching ring 4, an arc forms between these parts, said arc not touching the contact members 54*a*, 54*b*. When the tip of the switching pin 5 passes the opening in the second switching ring 6, the arc commutates to the latter. It then burns between the first switching ring 4 and the second switching ring 6 and is blown from heating volume 3 and extinguished upon the next current zero crossing.

In the case of the tenth embodiment of the consumable switching arrangement according to the invention, said tenth embodiment corresponding, incidentally, essentially to the ninth embodiment, the connecting elements of the switching pin 5 illustrated diagrammatically in FIGS. 11*a*–11*i* are designed differently. The connecting element 55*b* forms a central opening 56, through which the connecting element 55*a* bent in the shape of an S is guided.

It goes without saying that innumerable modifications of the exemplary embodiments described are possible within the scope of the invention. Thus, for example, a switching pin that can be spread mechanically or by the electromagnetic effect of antiparallel currents (fourth to eighth embodiments) can consist of just two parts; conversely, a switching pin in the case of which the effect of parallel currents is utilized (ninth embodiment) can also have more than two contact members. It is also conceivable to apply the contact forces with respect to the first switching ring and the second switching ring using different methods or to combine two methods—for example mechanical spreading and electromagnetic spreading by means of antiparallel currents—with the same switching ring.

Obviously, numerous modifications and variations of the present invention are possible in light of the above teachings. It is therefore to be understood that within the scope of the appended claims, the invention may be practiced otherwise and as specifically described herein.

What is claimed as new and desired to be secured by Letters Patent of the United States is:

1. A consumable switching arrangement comprising:

a first switching member, which is connected to a first electrical terminal at least in a switched-on position, and a second switching member, which is connected to a second electrical terminal at least in the switched-on position, said second switching member comprising a switching pin fastened to a mount, said mount being displaceable along a switching axis relative to the first switching member between the switched-on position, in which the switching pin touches the first switching member and the consumable switching arrangement thereby closes a current path between the first terminal and the second terminal, and a switched-off position, in which the switching pin is spaced apart from the first switching member, wherein the first switching member comprises a first switching ring, wherein the second switching member further comprises a second switching ring, which, in the direction of the switching axis, is separated from the first switching member by an arc space, and wherein the switching pin is mounted such that it presses against the first switching member in a first contact zone and against the second switching ring in a second contact zone in the switched-on position under the action of mechanically or electromagnetically generated contact forces.

2. The consumable switching arrangement as claimed in claim 1, wherein the switching pin presses against an inner side of the first switching ring in the switched-on position.

3. The consumable switching arrangement as claimed in claim 2, wherein the diameter of the opening in the first switching ring is less than the diameter of the opening in the second switching ring, and wherein, in the switched-on position, the tip of the switching pin at least approximately fills the opening in the first switching ring and the switching pin tapers in a step-like manner between the second switching ring and the first switching ring.

4. The consumable switching arrangement as claimed in claim 2, wherein the cross section of the switching pin has an at least approximately polygonal contour in the region of at least one contact zone.

5. The consumable switching arrangement as claimed in claim 1, wherein the switching pin presses against an inner side of the second switching ring in the switched-on position.

6. The consumable switching arrangement as claimed in claim 5, further comprising at least two contact members which are axially offset relative to one another, wherein in the switched-on position, at least one contact member touches the first switching ring with its contact surface and at least one contact member which is offset axially with respect to the same touches the second switching ring with its contact surface and the conductor is connected to the contact members at junction points which are offset relative to the tip of the switching pin and relative to the mount.

7. The consumable switching arrangement as claimed in claim 5, wherein, in the switched-on position, at least one contact member touches only the first switching ring, but an axial extent of the at least one contact member corresponds at least to the length of the arc space, with the result that the at least one contact member temporarily touches both the first switching ring and the second switching ring during the switch-off movement.

8. The consumable switching arrangement as claimed in claim 5, wherein, in the switched-on position, the switchin pin at least approximately fills the opening in the second switching ring.

9. The consumable switching arrangement as claimed in claim 1, wherein, in the switched-on position, the switching pin is elastically deflected or elastically deformed by the contact with the first switching member.

10. The consumable switching arrangement as claimed in claim 9, wherein, in the switched-on position, the switching pin is supported by a spring element on the mount, said spring element being elastically compressed in the direction of the switching axis.

11. The consumable switching arrangement as claimed in claim 9, wherein, in the switched-on position, the switching pin is elastically deflected by lateral displacement transversely with respect to the switching axis.

12. The consumable switching arrangement as claimed in claim 11, wherein the switching pin is rigidly fastened to a connecting part which connects the the switching pin to the mount and allows not only the lateral elastic deflection of the switching pin but also elastic rotary deflection of the switching pin about the tilt axis.

13. The consumable switching arrangement as claimed in claim 12, wherein the connecting part is an elastic spring element.

14. The consumable switching arrangement as claimed in claim 13, wherein the connecting part is a leaf spring.

15. The consumable switching arrangement as claimed in claim 1, wherein the switching pin can be tilted about a tilt axis, which is directed transversely with respect to the switching axis and, in the switched-on position, lies between the first switching ring and the second switching ring such that said pin presses against the inner side of the first switching ring in the first contact zone and, at the same time, against the inner side of the second switching ring with the second contact zone.

16. The consumable switching arrangement as claimed in claim 15, wherein the switching pin is connected to the mount via a joint, through which the tilt axis runs.

17. The consumable switching arrangement as claimed in claim 16, wherein the joint is fitted on the end of an elastic rod rigidly connected to the mount.

18. The consumable switching arrangement as claimed in claim 1, wherein the second switching ring can be deflected elastically toward the first switching member and, in the switched-on position, the switching pin presses against said switching ring with an abutting surface pointing toward the first switching member.

19. The consumable switching arrangement as claimed in claim 18, wherein the second switching ring is divided into sectors, each of which is fastened to the inner edge of a corresponding sector of an annular disc, neighboring sectors being separated in each case by a noncontinuous slot preceding from the inner edge.

20. The consumable switching arrangement as claimed in claim 19, wherein the slots run radially.

21. The consumable switching arrangement as claimed in claim 1, wherein the switching pin comprises a support, connected to the mount, and comprises at least two parts in the region of at least one contact zone, at least one of which parts is a contact member which can be moved to a radially limited extent relative to the other part and is forced away from the other part by the contact forces in the switched-on position, with the result that it presses against the inner side of at least one of said switching rings with a contact surface on its outer side remote from the other part.

22. The consumable switching arrangement as claimed in claim 21, wherein the switching pin has, in the region of the contact zone, a group of two or more contact members arranged in a manner surrounding a switching-pin axis at an approximately identical axial distance from the tip of the switching pin.

23. The consumable switching arrangement as claimed in claim 22, wherein the contact members are parts of an integral sleeve.

24. The consumable switching arrangement as claimed in claim 22, wherein the group of contact members is arranged in a manner surrounding the support.

25. The consumable switching arrangement as claimed in claim 24, wherein the wedge surface is arranged circumferentially on the support.

26. The consumable switching arrangement as claimed in claim 21, wherein the support extends into the contact zone.

27. The consumable switching arrangement as claimed in claim 21, wherein the support has a wedge surface pointing in a slanted manner toward the tip of the switching pin, and the at least one contact member can be displaced axially at least to a limited extent relative to the support and bears with a spreading surface on the wedge surface of the support, with the result that it is spread outward from the support in the switched-on position by the action of the wedge surface on the spreading surface.

28. The consumable switching arrangement as claimed in claim 27, wherein on its outer side, the at least one contact member has a stop surface pointing toward the tip of the switching pin, said stop surface serving to interact with a stop.

29. The consumable switching arrangement as claimed in claim 27, wherein an elastic force directed toward the tip of the switching pin is applied to the at least one contact member relative to the support.

30. The consumable switching arrangement as claimed in claim 29, wherein the elastic force is applied by a spring element supported on the support.

31. The consumable switching arrangement as claimed in claim 21, wherein the support has a pressing surface, which points in a slanted manner toward the mount and opposite which is situated a compression surface of the at least one contact member.

32. The consumable switching arrangement as claimed in claim 21, wherein, in the switched-on position, only the contact surface of the at least one contact member touches one of said switching rings and only at one junction point, which is axially offset relative to the contact surface, is said contact surface electrically conductively connected to a conductor of the switching pin, said conductor being parallel to the at least one contact member and being in electrically conductive contact with the second electrical terminal, such that the current path runs through the conductor, the junction point and further in the opposite direction through the contact member.

33. The consumable switching arrangement as claimed in claim 32, wherein the conductor is formed by a portion of the support.

34. The consumable switching arrangement as claimed in claim 21, wherein the contact members are arranged on parallel extensions, which can move radially at least to a limited extent relative to one another, such that the respective contact surface is offset by an angle greater than 90° relative to the extension with regard to the axis of the switching pin.

35. The consumable switching arrangement as claimed in claim 34, wherein the extensions can be bent elastically in the direction of the axis of the switching pin.

36. The consumable switching arrangement as claimed in claim 34, wherein each contact member is connected to the extension which supports it by a connecting element following a helix.

37. The consumable switching arrangement as claimed in claim 34, wherein the extensions and contact members adjoin the end of the support integrally therewith.

38. The consumable switching arrangement as claimed in claim 34, wherein the switching pin has two mutually opposite contact members.

39. The consumable switching arrangement as claimed in claim 38, wherein one contact member is connected to the extension which supports said one contact member with a connecting element, which has a central opening which is continuous transversely with respect to the axis of the switching pin, and the other contact member is connected to the extension which supports the other contact member with a further connecting element, which is guided through said opening.

40. The consumable switching arrangement as claimed in claim 34, wherein the contact members are arranged on parallel extensions, which can move radially at least to a limited extent relative to one another, such that the respective contact surface is offset by an angle of 180°, relative to the extension with regard to the axis of the switching pin.

* * * * *